US005190384A

United States Patent [19]

Speicher

[11] Patent Number: 5,190,384

[45] Date of Patent: Mar. 2, 1993

[54] DOME AND ROUND PARTS ROTARY MARKER

[75] Inventor: Edwin W. Speicher, Pittsburgh, Pa.

[73] Assignee: M. E. Cunningham Company, Ingomar, Pa.

[21] Appl. No.: 834,170

[22] Filed: Feb. 11, 1992

Related U.S. Application Data

[63] Continuation-in-part of Ser. No. 792,438, Nov. 15, 1991, which is a continuation of Ser. No. 562,737, Aug. 3, 1990, abandoned.

[51] Int. Cl.[5] ..... B41J 1/30

[52] U.S. Cl. ..... 400/128; 400/134; 101/35

[58] Field of Search ..... 101/4, 18, 35, 93.48; 400/102, 112, 127, 128, 129, 134

[56] References Cited

U.S. PATENT DOCUMENTS

| | | | |
|---|---|---|---|
| 3,054,494 | 9/1962 | Rizzetti | 400/128 |
| 3,630,334 | 12/1971 | Connolly et al. | 400/128 |
| 4,428,283 | 1/1984 | Rudolph et al. | 101/35 |
| 4,898,485 | 2/1990 | Speicher | 400/128 |

FOREIGN PATENT DOCUMENTS

| | | | |
|---|---|---|---|
| 285597 | 10/1988 | European Pat. Off. | 101/4 |
| 2656615 | 6/1977 | Fed. Rep. of Germany | 400/128 |
| 122779 | 6/1987 | Japan | 101/4 |

*Primary Examiner*—Edgar S. Burr
*Assistant Examiner*—Ren Yan
*Attorney, Agent, or Firm*—Stanley J. Price, Jr.

[57] ABSTRACT

A rotor supports a plurality of marking devices in spaced relation around the arcuate surface of an object to be marked which is fixed relative to the rotor. The rotor is mounted for rotation about an axis which is coaxial with an axis of the object to be marked. The rotor is also linearly movable on the axis. Each marking device includes a single impact pin positioned to extend and retract relative to the object to impress an identification mark, such as a dot, on the arcuate surface of the object. The impact pins are remotely controlled by a computer to inscribe on the object an array of dots in parallel rows to form desired programmed characters on the object. The impact pins are moved in a raster pattern by rotational and linear movement of the rotor in a preselected direction relative to the object. The impact pins are actuated to impress dots on the surface of the object in a first arcuate row. The rotor is then linearly advanced to place the impact pins in position for impressing dots in a second arcuate row spaced from the first row. The rotor rotates in a direction opposite to the first direction as dots are simultaneously impressed in an arcuate path on the object in the second row. The rotor is again linearly advanced to position the pins for the next arcuate row of dots.

20 Claims, 8 Drawing Sheets

DOME AND ROUND PARTS ROTARY MARKER

CROSS-REFERENCE TO RELATED APPLICATION

This application is a continuation-in-part of copending application Ser. No. 792,438 filed Nov. 15, 1991, entitled "Method And Apparatus For Simultaneously Forming A Plurality Of Characters On The Surface Of An Object" which is a continuation of copending application Ser. No. 562,737 filed Aug. 3, 1990, now abandoned.

BACKGROUND OF THE INVENTION

1. Field of the Invention

This invention relates to method and apparatus for marking an object by imprinting characters on an arcuate surface of the object and more particularly to apparatus for simultaneously imprinting on the arcuate surface of an object indented dot portions of selected characters to simultaneously form the characters on the arcuate surface.

2. Description of the Prior Art

The printing or engraving of alphanumeric characters on a workpiece, such as sheet material in the form of paper or the like, as well as machine parts, by dot matrix type computer controlled printing is well known. U.S. Pat. Nos. 4,306,497 and 4,446,789 are examples of dot matrix type printers operable to perform high speed printing of various types of characters in the output of computer generated printing for use with data and word processing systems. These types of printers include a plurality of print elements of the dot type each having a single impact wire for printing dots on a sheet of paper which is vertically fed opposite the printer head after each line of printing is formed on the paper.

U. K. Patent No. 2,002,694 discloses an engraving machine for a dot matrix printing on machine parts, utilizing a single impact tool or punch mounted on a carriage for movement in a raster pattern along a X-axis and a Y-axis. The punch impacts the workpiece to form alphanumeric characters from a selected array of dots impressed on the surface of the workpiece. The engraver is computer controlled to provide selective continuous marking of the workpiece in a raster pattern. The surface of the workpiece to be marked is maintained in a horizontal plane and stationary relative to the punch. The punch is moved in the raster pattern to imprint the selected array of dots on the horizontal surface to generate the desired alphanumeric characters on the workpiece.

U.S. Pat. No. 4,591,279 is a further example of a marking apparatus for imprinting alphanumeric characters in dot matrix form on production line items, such as slabs, rolled stock, plates, tags, and a variety of parts fabricated of material that includes glass, metal, and plastic. A marking head assembly includes a plurality of impact pins which are reciprocated into and out of contact with the flat planar surface of a workpiece by operation of computer programmable solenoid valves. An indexing wheel adjusts the angular position of the marking head assembly to control the size of the characters formed by the pins impacting the workpiece. The marking head assembly is pivotally mounted on a plate. A ball screw drive connects the plate to a frame for imparting longitudinal movement to the plate as the marking head assembly imprints a plurality of dots in a preselected array on the surface the workpiece to form the desired alphanumeric characters.

It is also known to impress a preselected array of dots on the surface of an object having an arcuate contour. U.S. Pat. No. 4,848,942 discloses marking apparatus for imprinting dot matrix characters on the arcuate surface of a cylindrical object. The cylindrical object is rotatably supported by rollers, and a driver roll controls the rate of rotation of the object. A plurality of marking pins are positioned in a fan-shaped array around the periphery of the arcuate surface of the object to be marked. Each marking pin is reciprocally supported and actuated by an electrically operated solenoid to extend and retract to indent the surface of the object with a dot. The object is rotated relative to the plurality of fixed marking pins. The pins are selectively actuated to imprint a preselected array of dot matrix characters around the circumference of the arcuate object.

Electric solenoids are selectively programmed for operation to extend and retract the pins in a controlled manner to indent the object with dots to form a single line dot matrix array of characters. As disclosed in U.S. Pat. No. 4,848,942 each pin is set at a different level and each pin forms a different row of dots. The spacing between the rows of dots determines the height of the characters being formed. Accordingly, the marking pins are adjustable on a marking head assembly to adjust the height of the characters. The object rotates 360° plus the length of the marking head assembly in order to imprint characters around the complete circumference of the object.

While it is known to imprint dot matrix type characters on a surface of a workpiece and particularly the arcuate contour of a workpiece, the known devices utilize a plurality of impact markers to form rows of dots in a preselected array to form the desired characters on the surface of the object. Each impact marker is used to form the required dots in a specific row. As disclosed in U.S. Pat. No. 4,848,942, the marking pins must be set on different levels so that the rows of dots are spaced a preselected distance apart to provide the required height for the characters formed by the composite array of dots. Accordingly, the marking pins must be precisely mounted to assure the required spacing between rows of dots. If the height of the characters is to be adjusted, then the position of each marking pin must be adjusted on the marking head assembly.

Adjustments in the positioning of the marking pins and maintaining the required position of the pins substantially adds to the complexity of the marking head assembly. Also, in order to form characters around the complete circumference of the object, the object must be moved through 360 degrees while the marking pins remain stationary relative to the rotating object. In order to print a row of dots the object must be rotated over one complete revolution. This method of forming characters around the circumference of an arcuate shaped object where the object moves relative to the fixed marking pins is more time consuming than desired.

Therefore, there is need in the marking of dot matrix type characters on the arcuate surface of an object for a marking device that utilizes a plurality of impact markers to form an array of dots on the arcuate surface. The imprinting of the dots needs to be accomplished without requiring the object to rotate through a complete revolution. The impact markers should be efficiently mounted on a marking head so as not to require individual adjustment of the position of each impact marker.

There is need for an arrangement permitting the position of the impact markers to be adjusted relative to the object by a single adjustment of the marking head assembly so that the rows of dots forming the characters are spaced an equal distance apart.

SUMMARY OF THE INVENTION

This invention relates to apparatus for marking a selected array of characters in an arcuate path on the surface of an object that includes a support member positioned adjacent to the object to be marked. The support member has a reference plane parallel to an axis of the object. A carriage is mounted on the support member for movement parallel to the reference plane with the object to be marked remaining fixed relative to the carriage. First drive means is drivingly connected to the carriage for linearly moving the carriage to a preselected position on the support member relative to the surface of the object. A rotor is supported by the carriage in coaxial alignment with the surface of the object to be marked for rotation relative to the object in a preselected direction. Marking means is provided for imprinting a preselected array of characters on the surface of the object. Means is provided for supporting the marking means radially on the rotor for movement into and out of contact with the surface of the object. Second drive means is connected to the rotor for rotating the rotor through a preselected angle in a first direction about the axis of the object. Actuating means selectively actuates the marking means to mark the surface of the object with portions of the selected array of characters on a first line radiating in an arcuate path about the axis of the object as the rotor rotates in a first direction through a preselected angle about the object. The first drive means linearly moves the carriage a preselected distance on the support member for rotation of the rotor by the second drive means in a second direction opposite to the first direction through a preselected angle. The actuating means actuates the marking means to mark the surface of the object on a second line spaced from and radiating in an arcuate path parallel to the first line with other portions of the selected array of characters.

Further, in accordance with the present invention there is provided a method for marking a selected array of characters on the surface of an object that includes the steps of positioning a carriage on a support member for movement parallel to a reference plane with the object to be marked remaining fixed relative to the carriage. The carriage is linearly moved coaxially relative to the surface of the object to a preselected position on the support member. A rotor is positioned on the carriage in coaxial alignment with an axis of the object. Marking means is positioned radially on the rotor for imprinting a selected array of characters on the arcuate surface of the object. The rotor is rotated through a preselected angle in a first direction about the axis of the object. The marking means is actuated to mark the surface of the object with portions of the selected array of characters on a first line radiating about the axis of the object as the rotor rotates in a first direction through a preselected angle relative to the object remaining fixed. The carriage is linearly moved on the support member to move the rotor relative to the object. The rotor is rotated in a second direction opposite to the first direction through a preselected angle. The marking means is actuated upon rotation of the rotor in the second direction to mark the surface of the object on a second line spaced from and parallel to the first line with the other portions of the selected array of characters.

Further in accordance with the present invention, there is provided a rotary marking device that includes a rotor and support means for rotatably supporting the rotor about an axis coaxially aligned with an axis of an object having an arcuate surface to be marked. The rotor is linearly movable on the support means along said axis. A marking device is provided for imprinting a selected array of characters on the arcuate surface of the object. Positioning means positions the marking device to extend radially on the rotor relative to the arcuate surface of the object. Means is provided for actuating the marking devices to selectively imprint an array of characters on the arcuate surface of the object. Drive means rotates the rotor in a preselected direction through a preselected angle about the axis and linearly advances the rotor along the axis as the marking device marks the arcuate surface of the object with dots in a raster pattern to form the selected characters on the arcuate surface of the object.

Accordingly, the principal object of the present invention is to provide method and apparatus for marking portions of an array of characters on an arcuate surface of an object by rotating a marking device about the object and linearly advancing the marking device coaxially relative to the object.

Another object of the present invention is to provide a rotary marker comprising a plurality of marking elements radially positioned on a rotor for forming a plurality of characters simultaneously on the arcuate surface of an object which remains fixed as the marking elements rotate in a first direction through a preselected angle to impress dots on one line on the object and then are advanced longitudinally to the next position for rotation in an opposite direction for impressing additional dots forming other portions of the characters where the remaining portions of the characters are formed by continued radial and linear movement of the marking elements in a raster pattern.

A further object of the present invention is to provide method and apparatus for simultaneously marking a preselected array of characters formed by dots impressed on an arcuate surface of an object by a plurality of radially positioned marking devices which are moved in a raster pattern radially and linearly to form dots in lines on the arcuate surface.

These and other objects of the present invention will be more completely disclosed and described in the following specification, accompanying drawings, and appended claims.

DESCRIPTION OF THE PREFERRED EMBODIMENTS

Figure 11:
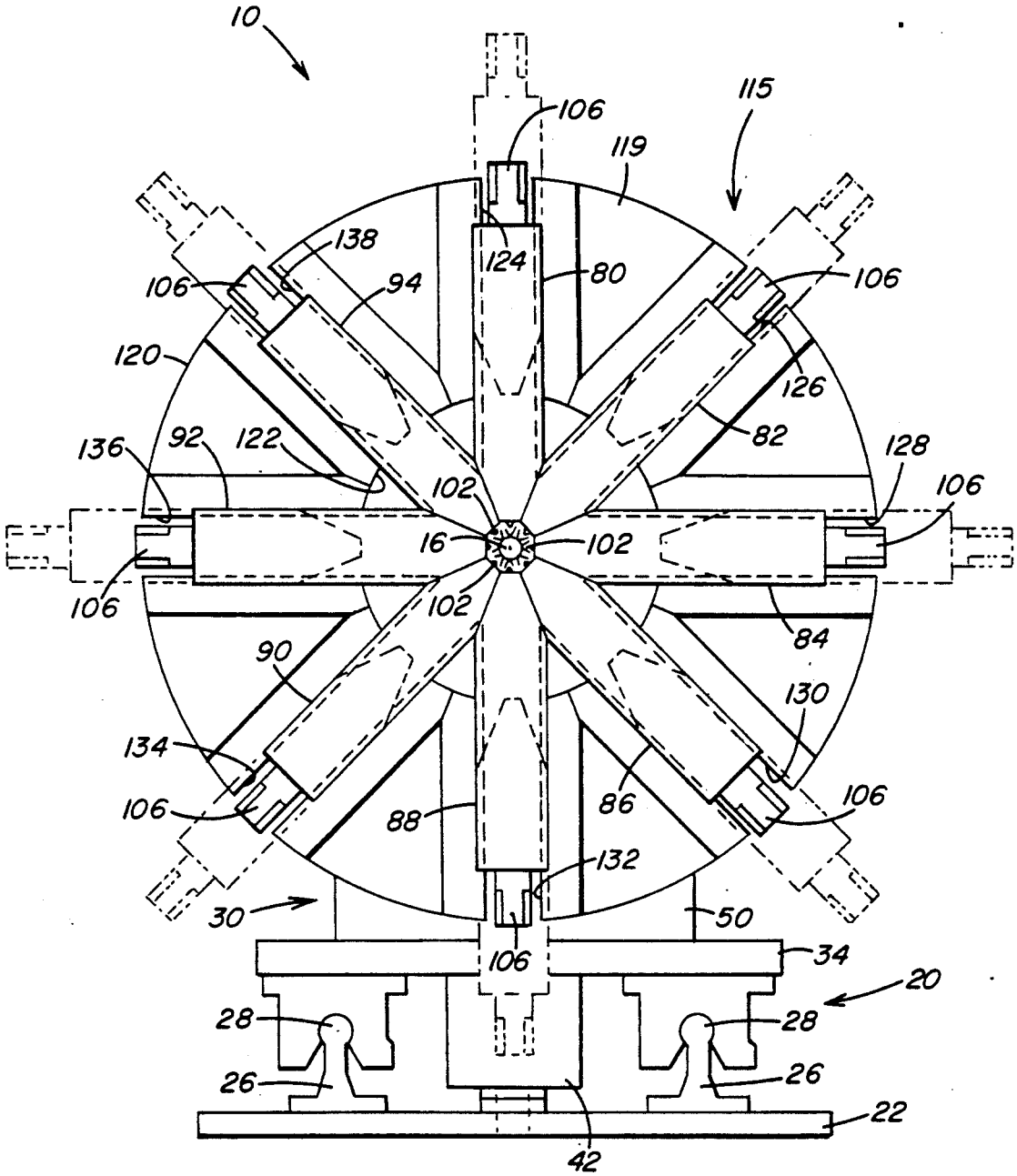
FIG. 11 is a front elevational view of another embodiment of the rotary marking device of the present invention.
Figure 12:
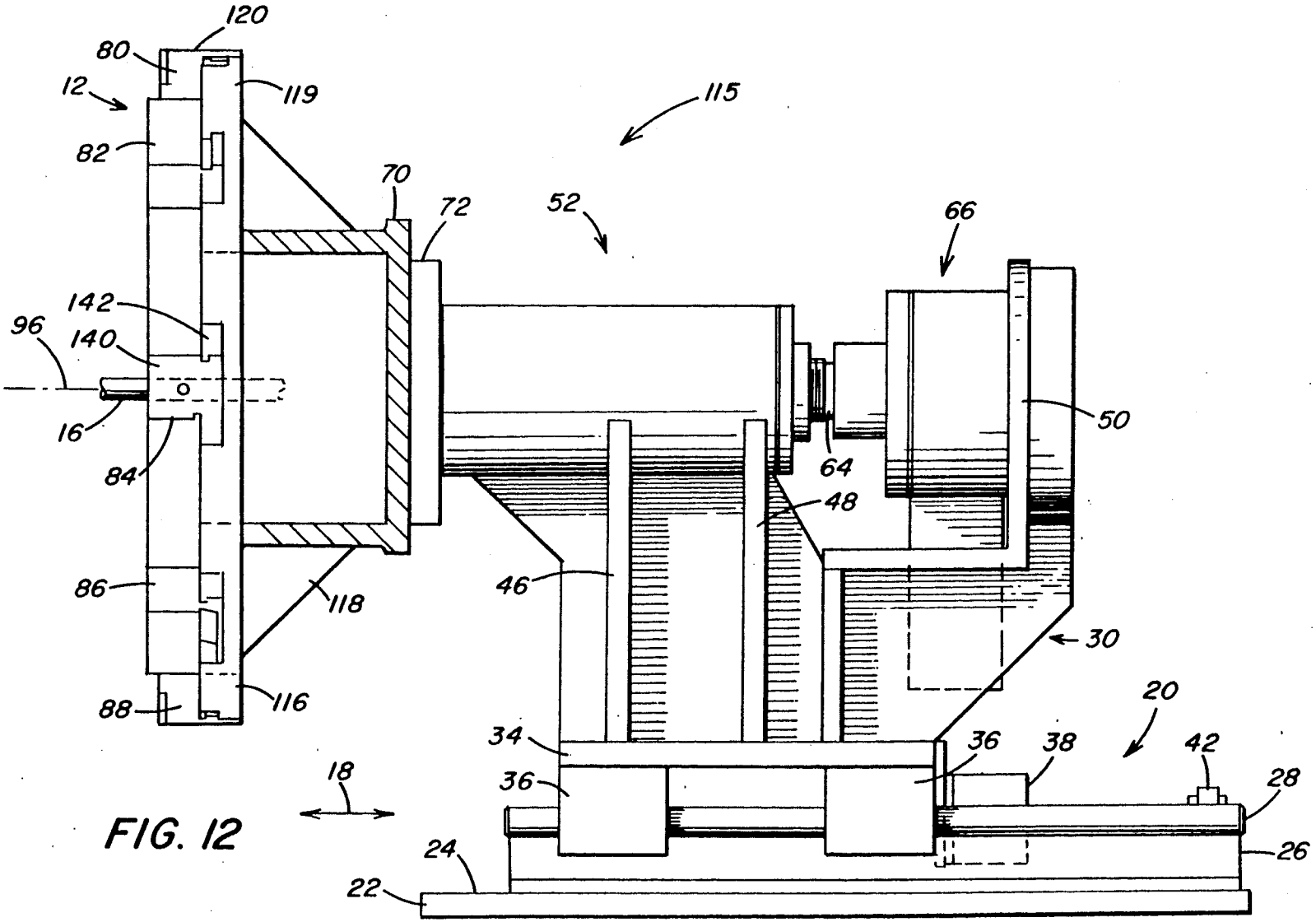
FIG. 12 is a view in side elevation of the rotary marking device shown in FIG. 11.

Referring to the drawings and particularly to FIGS. 1–4, there is illustrated marking apparatus generally designated by the numeral 10 for supporting a rotary marker generally designated by the numeral 12 for movement into and out of position for marking an arcuate surface 14 of an object 16. The rotary marker 12 is operable to impress a preselected array of alphanumeric characters on the arcuate surface of object, such as the arcuate surface 14 forming the dome of cylinder 16. As will be discussed later in greater detail, the marking apparatus, illustrated in FIGS. 11 and 12, is also operable to form alphanumeric characters on a round object such as a shaft, pipe or the like. The round or dome shaped object to be marked by the marking apparatus 10 of the present invention may be composed of any type of material, such as glass, metal, or plastic, capable of being impressed with a mark that is permanently retained on the object.

Figure 1:
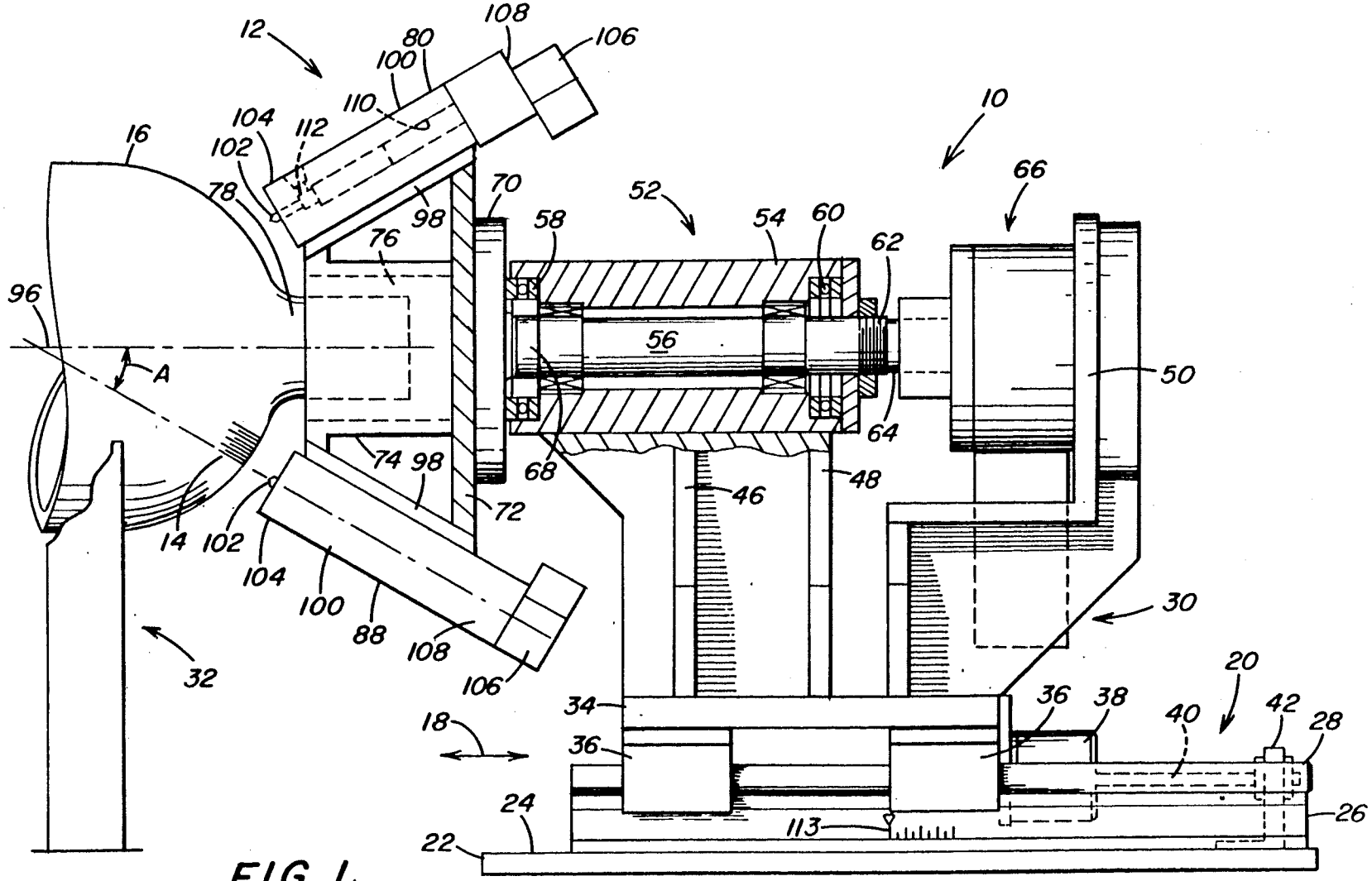
FIG. 1 is a fragmentary view in side elevation and partially in section of a rotary marking device, illustrating a plurality of impact markers positioned for rotational and longitudinal movement relative to a fixed object having an arcuate surface to be marked with a selected array of characters.
Figure 2:
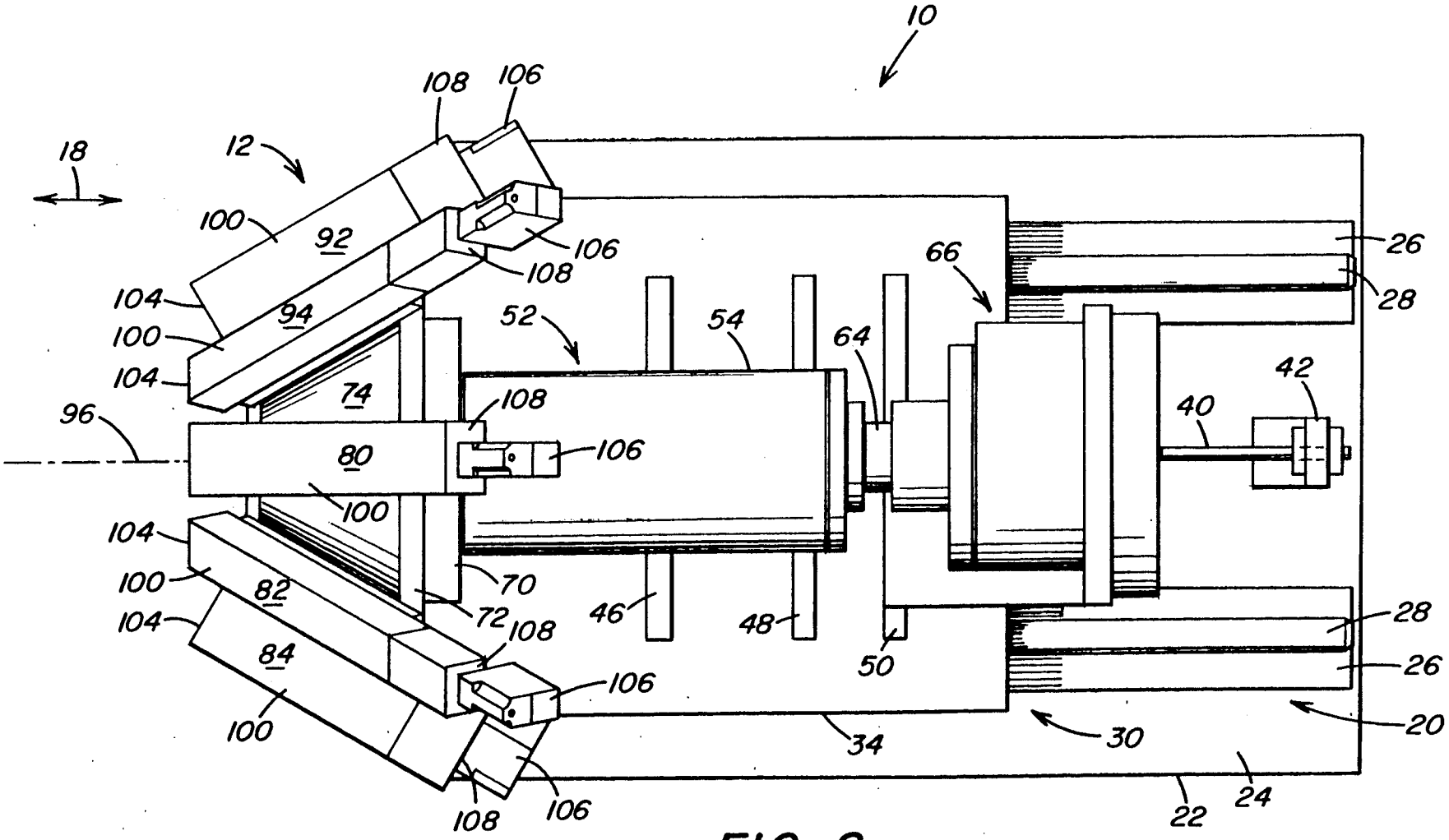
FIG. 2 is a top plan view of the marking device shown in FIG. 1.
Figure 4:
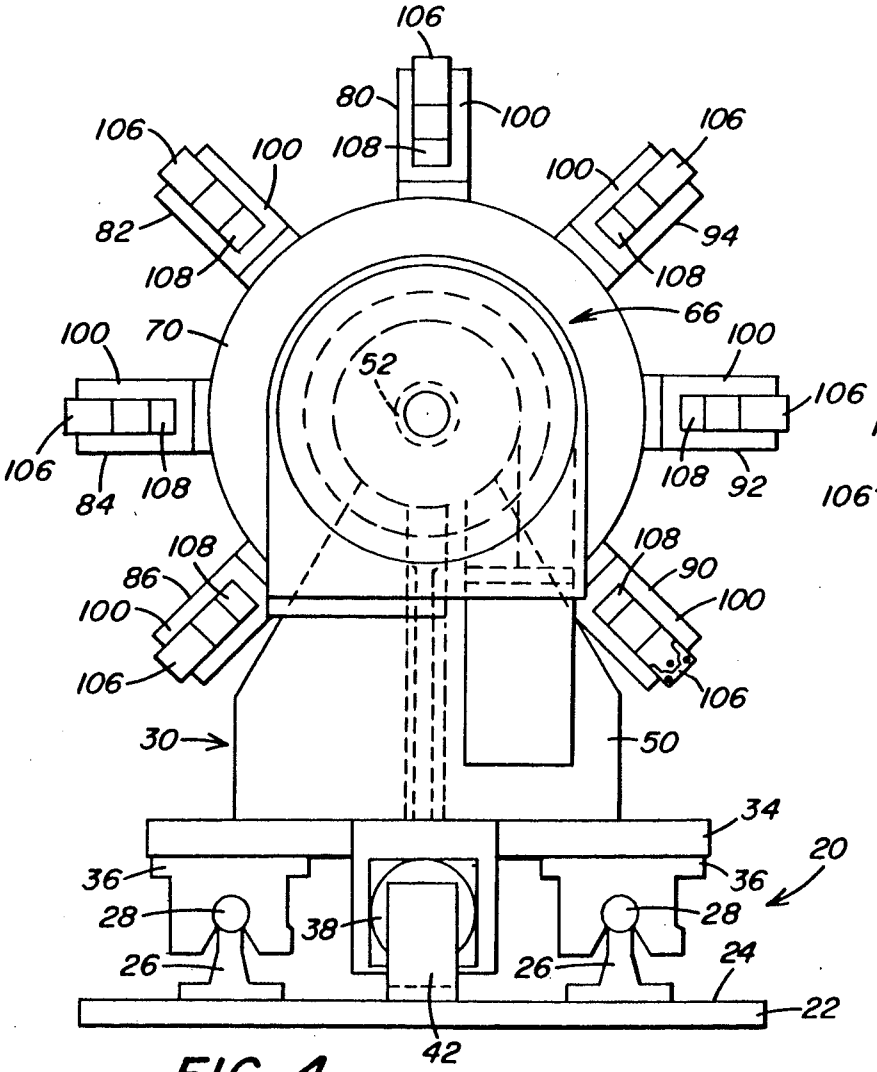
FIG. 4 is a rear elevational view of the marking device shown in FIG. 1.

As shown in FIGS. 1 and 2, the marking apparatus 10 is mounted for movement in a horizontal reference plane in the direction of arrow 18 on a support system generally designated by the numeral 20. The support system 20 includes a base or platform 22 having an upper surface 24 that forms a generally horizontal reference plane relative to the arcuate surface 14 of the round or dome shaped object 16 to be marked. The base 22 is stationarily positioned on a suitable foundation. A pair of pedestals 26 as seen in FIG. 4 are secured to the base 22 in spaced parallel relation and extend substantially the length of the base 22. Guide rails 28 are rigidly mounted on and supported by the pedestals 26.

A carriage generally designated by the numeral 30 is mounted on the support system 20 for movement parallel to the horizontal reference plane of the base 22 in the direction of arrow 18. The object 16 to be marked is stationarily positioned on an upstanding guide and clamp mechanism generally designated by the numeral 32 in FIG. 1. The mechanism 32 may be any suitable structure that rigidly supports and stationarily retains the object 16 to be marked along its entire length as the rotary marker 12 moves relative to the object 16. The object 16 can be positioned either horizontally as shown in FIG. 1 or vertically with respect to a vertical reference plane rather than a horizontal reference plane as also shown in FIG. 1. Therefore, the reference plane of the base 22 for the apparatus 10 may be positioned either horizontally or vertically or even at an angle therebetween, if desired.

The carriage 30 includes at its lower end portion a support plate 34 with a plurality of slide beds 36 secured to and extending downwardly from the bottom of the support plate 34. The slide beds 36 are arranged in tandom pairs and spaced apart on the guide rails 28. The slide beds 36 are movable on the guide rails 28 in the horizontal reference plane and in the direction 18 indicated in FIG. 1. With this arrangement the carriage 30 is positioned for reciprocal movement back and forth on the support system 20.

A motor 38 mounted on the support system 20 is drivingly connected by a conventional ball screw-type drive to the carriage 30 for advancing the carriage 30 on the guide rails 28 in the direction 18. The motor 38 is a conventional DC stepper motor. The motor 38 includes a drive shaft 40 rotatably supported by a bracket 42 on the base 22. The drive shaft 40 is connected within the motor housing to a ball nut (not shown) that rotates with the drive shaft 40. A ball screw extends through the ball nut and a ball screw guide (also not shown) is connected in a conventional manner to the ball screw. The ball screw guide is secured to the carriage support plate 34. With this arrangement, rotation of the drive shaft 40 in a preselected direction rotates the ball nut to nonrotatably linearly move the ball screw so that the carriage 30 moves linearly in a preselected direction as indicated by the arrow 18 on the guide rails 28. Another ball screw drive arrangement suitable for use with the present invention is disclosed in U.S. Pat. No. 4,557,191 which is incorporated herein by reference.

The carriage 30 includes a plurality of upstanding support members 46, 48 and 50 which form a frame for supporting an upper support assembly generally designated by the numeral 52. The upper support assembly 52 is thus mounted on the carriage 30 to move with the carriage 30 linearly in a horizontal plane on the guide rails 28 relative to the fixed object 16. The upper support assembly 52 includes a housing 54 for receiving a drive shaft 56 that is rotatably supported within the housing 54 by sealed bearings 58 and 60. The drive shaft 56 includes a first end portion 62 that is coupled to an output shaft 64 of a programmable rotary unit generally designated by the numeral 66 that includes a conventionally known stepper motor which is controlled from a central processing unit (not shown). The rotary unit 66 is also supported by the upper support assembly 52 on the carriage 30.

The drive shaft 56 includes a second end portion 68 having a support plate 70 secured thereto for rotation with the drive shaft 56. The support plate 70, in turn, is connected to a rotor 72. The rotary marker 12 is carried by the rotor 72. With this arrangement, rotation of the drive shaft 56 is transmitted to the rotor 72 to rotate the rotary marker 12. The axis of rotation of the drive shaft 56 and rotor 72 is coaxially aligned with the longitudinal axis of the object 16 having the arcuate surface 14 to be marked. The axis of rotation is also parallel to the horizontal reference plane of the base 22.

The rotor 72 includes a central hub portion 74 having a recess 76 for receiving in spaced relationship an end 78 of the object 16 to be marked. As illustrated in FIG. 1, the object 16 may be cylindrically shaped, such as a bottle, having a dome surface 14 which is to be marked by the rotary marker 12. The bottle includes a neck portion corresponding to the end portion 78 which extends into the recess 76 of hub portion 74 but does not contact the hub portion 74. The rotor 72 is freely rotatable relative to the object 16 which is stationarily supported on the guide and clamp mechanism 32. The hub portion 74 can accommodate a wide range of bottle diameters, for example, from about four inches to twenty inches in diameter.

Figure 3:
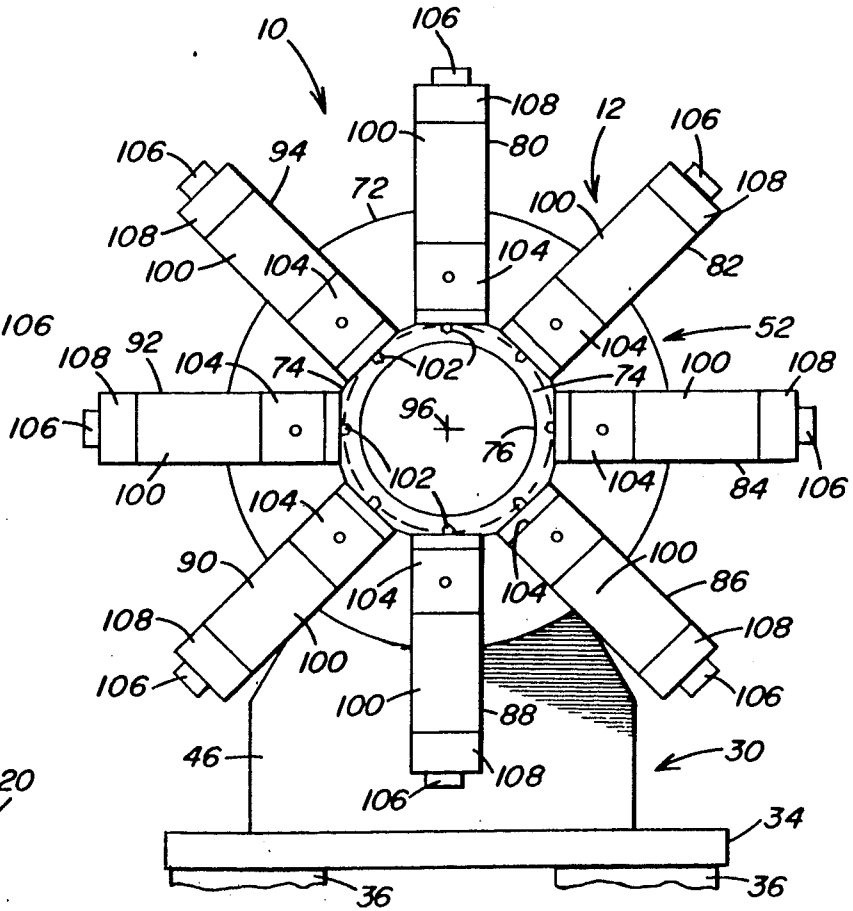
FIG. 3 is a front elevational view of the marking device shown in FIG. 1, illustrating the impact markers positioned radially in spaced relation on a rotor coaxially positioned relative to the arcuate surface of the object to be marked.
Figure 6:
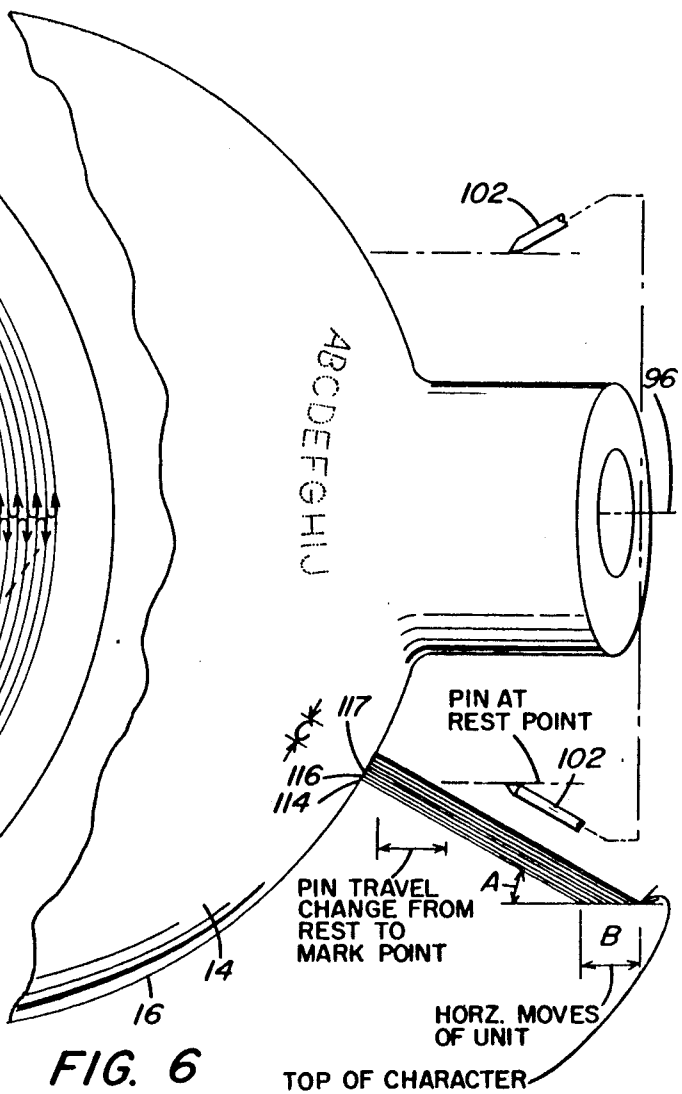
FIG. 6 is a fragmentary view in side elevation of the object shown in FIG. 5 having an arcuate surface to be marked, schematically illustrating the range of horizontal movement of one of the impact markers for forming dots in rows spaced an equal distance apart.
Figure 5:
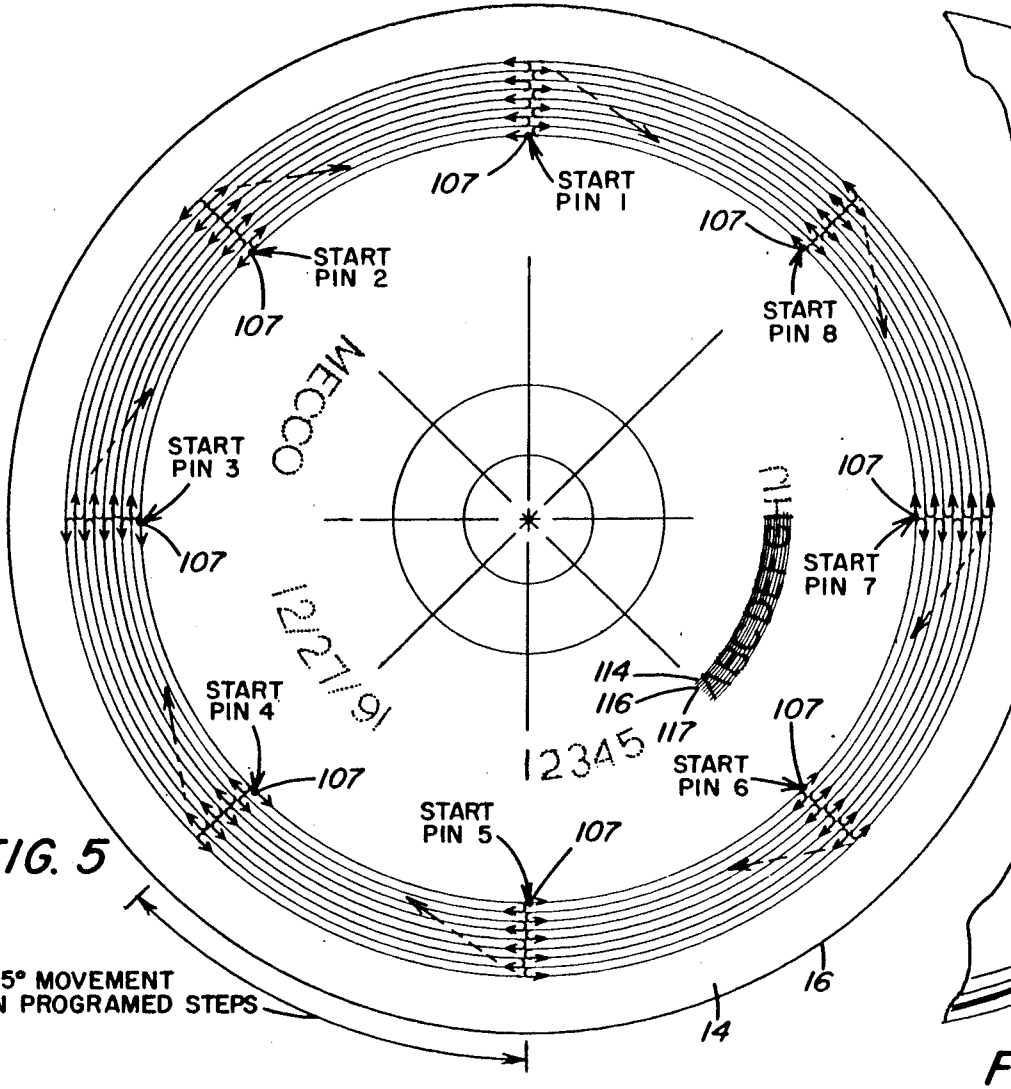
FIG. 5 is a front view of a cylindrical object, schematically illustrating a raster pattern of movement of the impact markers to simultaneously form on the arcuate surface of the object by combined rotational and linear movement of the impact markers a plurality of dots line by line on the arcuate surface of the object.
Figure 7:
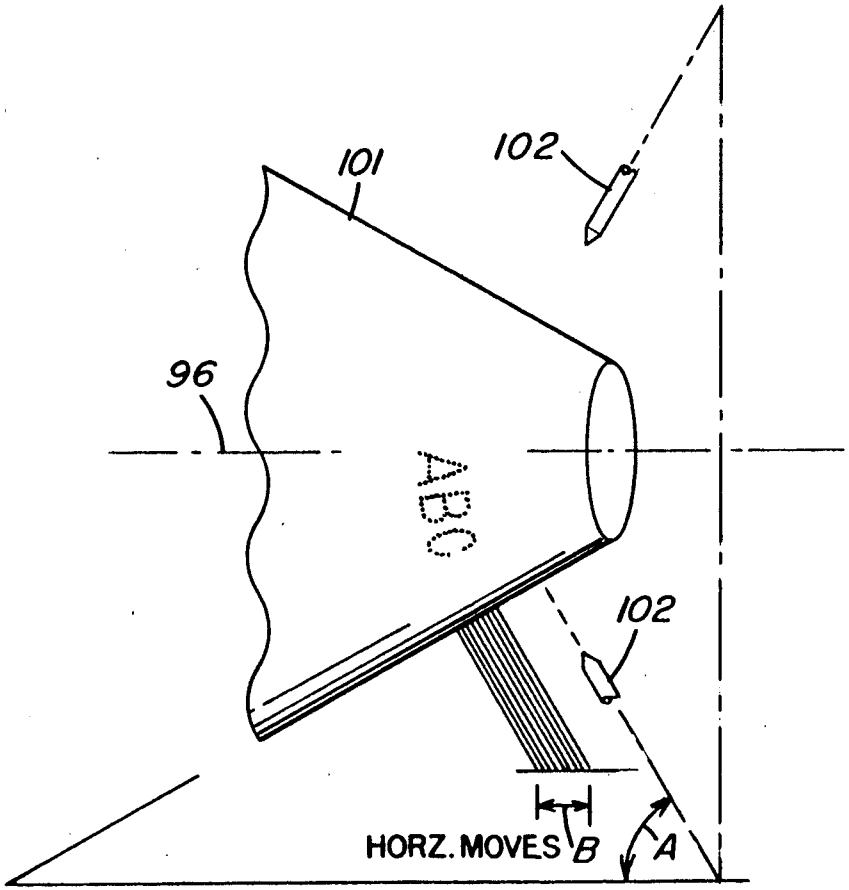
FIG. 7 is a fragmentary view in side elevation similar to FIG. 6, schematically illustrating the imprinting of characters on the arcuate surface of a cone by rows of dots extending around the cone and perpendicular to the longitudinal axis of the cone.

A plurality of marking devices 80–94 are positioned radially in spaced relation on the rotor 72 around the object 16. Preferably, as illustrated in FIGS. 3 and 4, eight marking devices 80–94 are equally spaced around the hub portion 74, however, any number can be utilized. With the embodiment of the marking apparatus 10 shown in FIGS. 1–4, the marking devices 80–94 are positioned on the rotor 72 to extend at a preselected angle A with respect to the longitudinal axis of the object 16. Each of the marking devices 80–94 is mounted on the rotor 72 to extend at an angle A with respect to the longitudinal axis 96. The angle at which the marking devices extend is determined by the geometric configuration of the object. Thus, the angle differs based on the shape of the object and the location on the object where the characters are impressed. FIGS. 5 and 6 illustrate marking the dome portion of a cylinder or bottle. FIG. 7 illustrates the surface of a cone being marked, FIG. 8 a shaft, and FIGS. 9 and 10 the planar surface of a circular plate.

The angle A shown in FIG. 1 for a cylindrical dome is approximately 60°. To support each of the marking devices 80–94 at the same angle with respect to the longitudinal axis 96, the rotor hub portion 74 includes an outer wall formed by a plurality of inclined plates 98. The plates 98 extend at a preselected angle on the hub portion 74 to provide a surface for supporting the marking devices 80–94 in the same angular position on the rotor 72 about the arcuate surface 14 of the object 16 to be marked.

The marking devices 80–94 shown in FIGS. 1–4 are identical units, each including a body portion 100 for reciprocally supporting an impact pin 102 at a pin outlet end portion 104 of body portion 100. The impact pins 102 project toward the arcuate surface 14 of the object 16 to be marked. Each marking device body portion 100 includes a solenoid valve 106 connected to a manifold block 108 which is mounted on the body portion 100. The manifold block 108 includes a passageway that communicates with a bore 110 in which the impact pin 102 is slidably retained. The solenoid valves 106 are operable to extend and retract the impact pins 102 to indent the surface 14 of the object 16 with dots to form the desired dot matrix character. After an individual dot is indented into the arcuate surface 14 of the object 16 by the impact pin 102, return air is introduced into a passageway 112 that communicates with the bore 110 to retract the pin 102 into the bore 110.

Each of the marking devices 80–94, illustrated in FIGS. 1–4, is similar to the marking devices described and illustrated in U.S. Pat. No. 4,652,156 which is incorporated herein by reference. Suitable control means, such as a computer, is connected through a keyboard and readout device (not shown) for actuating the solenoid valves 106 to permit a preselected array of characters to be formed by the impact pins 102 of the marking devices 80–94 on the object 16 to be marked. The size of the characters and the spacing of the characters is selective as determined in part by the diameter of the object to be marked and the number and the width of characters to be imprinted. Suitable computer programs are known for the computer to control movement of the impact pins 102 to form the preselected array of dot type characters on the object 16.

Now referring to FIGS. 5 and 6, there is illustrated the raster pattern path followed by the impact pins 102 of the marking devices 80–94 to impress a selected array of dot matrix characters on the arcuate surface 14 of the object 16. The pins 102 follow a raster path of movement generated by the combined sequential movement of rotation of the rotor 72 in a preselected direction through a preselected angle and linear movement of the rotor 72 relative to the object 16 which remains fixed. For purposes of illustration, only the raster pattern of movement of the eight pins 102 for devices 80–94 is shown in FIG. 5 superimposed on the dome portion of the object 16. The start point for each of the eight pins 102 is shown followed by the direction of rotational movement during which dots are selectively impressed in the row being marked. Then the pins are advanced linearly to move to the next row for rotational movement in the opposite direction. Referring to FIG. 6, it should be understood that each of the eight impact pins 102 moves rotationally and linearly in the raster pattern shown so that an entire array of characters is simultaneously impressed by all of the pins 102 for devices 80–94 completely around the circumference of the object 16 on the arcuate surface 14, if desired.

As shown in FIGS. 5 and 6 to begin the marking operation the carriage 30 is advanced by programmed operation of the stepper motor 38 horizontally on the base 22 to position the eight impact pins 102 at a preselected start point 107 along the longitudinal axis 96 of the object 16 for impressing a first row 114 of dots on the arcuate surface 14. Thus, in order to initiate the marking operation, the carriage 30 is advanced horizontally to a preselected start point 113 on the base 22 to locate each of the pins 102 at the desired start point 107 on the surface of the object 16. The incremental horizontal movement of the carriage 30 is indicated by the scale 113 on the base 22 shown in FIG. 1.

Once the impact pins 102 are moved to their respective start points 107, the stepper motor of the programmable rotary unit 66 is actuated to rotate the shaft 56 and the rotor 72 connected thereto in programmed steps through an arc, for example of 45°, in a counterclockwise direction, as shown in FIG. 5, to generate the desired dots and spacing between dots in the first row 114 around the entire circumference of the object 16. As the rotor 72 rotates in this direction, the impact pins 102 are extended to impact the arcuate surface 14 at selected points in the row 114. All the impact pins 102 are selectively actuated as desired so that marking occurs simultaneously in the first row 114 around the axis 96 as shown in FIG. 5. In this manner, selected dots are impressed in the first row 114 on the arcuate surface 14.

The dots are impressed on the first row 114, as shown in FIG. 5, at preselected locations for forming the desired characters as determined by the computer program that controls actuation of the solenoid valves for the marking devices 80–94. Once the rotor 72 completes rotational movement through the desired angle, for example 45°, the stepper motor 38 is actuated to advance the carriage 30 an incremental linear distance as shown in FIG. 6 for positioning the eight impact pins 102 opposite the desired point on the arcuate surface 14 for impressing selected dots in a second row 116.

With the arrangement of marking devices 80–94 on the rotor 72 as shown in FIGS. 3 and 4, alphanumeric characters are simultaneously formed around the complete circumference of the arcuate surface 14. For eight marking devices as shown in FIG. 5, each marking device is rotated through an angle of 45° so that selected dots are impressed completely around the arcuate surface 14. After each marking device has completed rotation through an angle of 45° for forming the dots in row 114, the carriage 30 is horizontally advanced a preselected distance and the rotary unit 66 is actuated to reverse the direction of rotation so that the rotor 72 moves through an angle of 45° in a clockwise direction or in an opposite direction back. The rotation in the opposite direction is commenced following the linear advancement of the carriage 30 on the base 22. The stepper motor 38 linearly advances the carriage 30 and rotor 72 the required distance to generate the dots at the desired location on the second row 116 spaced a desired distance from the first row 114.

As shown in FIGS. 5 and 6, the rows in which the dots are formed on the arcuate surface 14 are spaced an equal distance apart and the spacing between rows is determined by the height and number of the characters to be formed on the arcuate surface 14. However, due to the curvature of the arcuate surface 14, the incremental horizontal movement of the carriage 30, as shown in FIG. 6, is greater than the spacing between the rows of dots on the surface 14 of the object 16. For example, each impact pin 102 moves linearly a distance B to form nine rows of dots on the object surface 14. The linear distance B is approximately twice the height C of the characters formed by the nine rows of dots on the dome shaped object shown in FIG. 6.

As shown in FIG. 5, the impact pins 102 follow a raster pattern on the arcuate surface 14 in the formation of the parallel spaced rows of dots. The rows of dots are equally spaced from one another. However, the incremental linear movement of the carriage 30 between rows progressively increases as the carriage 30 advances along the longitudinal axis 96 of the object 16 because the diameter of the domed shaped surface 14 changes along axis 96. The incremental linear stepping movement of the carriage 30 again is controlled by operation of the stepper motor 38 which is, in turn, computer controlled. The program for the computer is designed to form the characters for the particular arcuate configuration of the object 16. In other words, the control of the motor 38 varies based on the diameter of the cylinder 16.

For the known geometric configuration of the object 16, the distance required for incremental linear advancement of the pins 102 between rows to maintain the rows of dots impressed on the surface 14 an equal distance apart is mathematically determined. The incremental advance varies based on the geometric configuration. The computer is programmed to provide the desired incremental linear advancement as determined by the shape of the object 16.

During the angular movement of the rotor 72, the carriage 30 remains fixed. The impact pins 102 for the marking devices 80–94 are selectively actuated at desired positions during the angular movement of the rotor 72 to simultaneously impress dots on the line or row of dots being formed. To impress the dots on the same line completely around the arcuate surface 14 of the object 16, the solenoid valves 106 for the respective marking devices 80–94 are individually computer actuated to form the desired dot pattern on a line.

Once the rotor 72 completes angular movement, for example through 45°, in a counterclockwise direction the stepper motor 38 linearly advances the rotor 72 the required horizontal distance to maintain equal spacing between the rows of dots, as shown in FIG. 6. Upon completion of the linear advancement which distance is greater than the spacing between the dot rows, the rotor 72 is rotated in the opposite direction, for example clockwise, by the rotary unit 66 through the same angle of movement as the movement in the counterclockwise direction.

As the rotor 72 rotates in a clockwise direction, for example, to form the second row 116 of dots shown in FIGS. 5 and 6, the eight impact pins 102 are actuated by the solenoid valves 106 to impress dots on the second row 116 at the desired locations for the selected array of characters to be formed. Upon completion of the rotational movement in the clockwise direction, the rotor 72 is again linearly advanced by movement of the carriage 30 by the computer controlled operation of the motor 38 a preselected linear distance, as shown in FIG. 6, to obtain marking of a third row 117 of dots which is equally spaced from the prior rows 114 and 116 of dots. Again the incremental linear advancement of the carriage 30 on the base 22 is greater than the spacing between the rows of dots being formed because of the change in the diameter of the dome shaped surface 14 along the axis 96. Thus, the linear travel of the impact pins 102 is controlled for each row of dots so that the spacing between the rows of dots impressed on the arcuate surface 14 does not change. The spacing between the rows of dots is determined by the desired height of the characters being formed.

The incremental rotational and longitudinal movement of the rotor 72 continues until the dot rows for the desired array of characters are formed on the arcuate surface 14. As illustrated by the example shown in FIGS. 5 and 6, nine rows of dots are impressed on the object 16 to form one row of completed characters, for example, the combination of letters and numerals shown in FIG. 5. If it is desired that a second row of completed characters be impressed on the arcuate surface 14 parallel to the first row of completed characters, then the rotor 72 is rotated through an angle of 90° rather than an angle of 45°. For an arrangement of eight marking devices positioned around the rotor 72, a set of four marking devices, for example as seen in FIG. 3 the devices 82, 86, 90, and 94, are used to impress the dots to form the first row of alphanumeric characters. The marking devices 80, 84, 88, and 92 would be used to impress the rows of dots to form the second row of alphanumeric characters.

In order for a second row of alphanumeric characters to be positioned parallel to the first row of characters, a spacer element or shim (not shown) is positioned between the plate 98 and the body portion 100 in the mounting of marking devices 80, 84, 88 and 92 on the rotor 72 shown in FIG. 1. By positioning a spacer element between the plate 98 and body portion 100 for each of the marking devices 80, 84, 88 and 92, the impact pins 102 of the respective marking devices are positioned on a diameter greater than the diameter formed by the pins 102 for marking devices 82, 86, 90 and 94. This arrangement allows for two lines of characters to be imprinted simultaneously on the arcuate surface 14.

Figure 8:
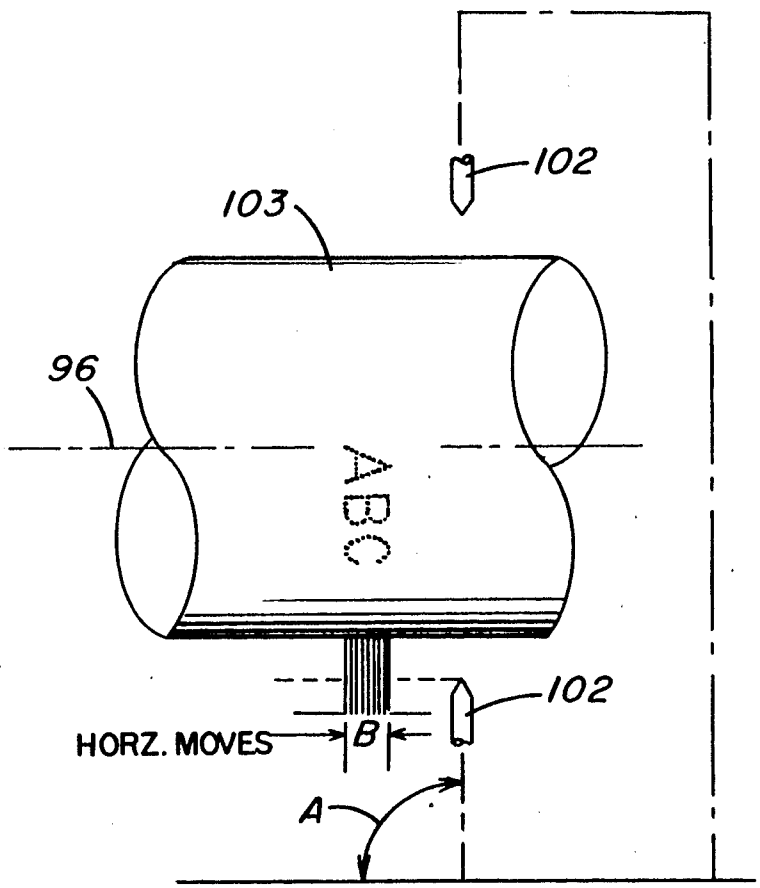
FIG. 8 is a fragmentary view in side elevation similar to FIGS. 6 and 7, schematically illustrating dot type characters formed on a shaft around the circumference of the shaft in accordance with the present invention.
Figure 9:
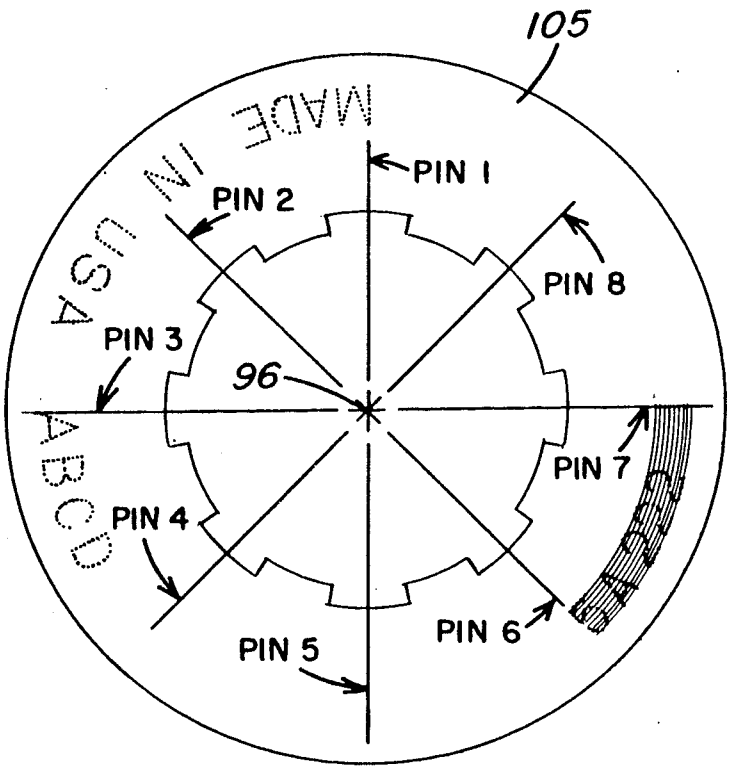
FIG. 9 is an end view of a circular plate, schematically illustrating the formation of dot type characters in an arcuate path on the planar surface of the plate.

Additional examples of imprinting dot type characters on the arcuate surface of an object in accordance with the present invention are shown in FIGS. 7–9. The formation of characters in arcuate rows on the surface of a cone 101 is shown in FIG. 7. The rows of dots are formed by the combined linear and rotational movement of the marking devices 80–94 as described above. The dot rows are equally spaced a preselected distance apart to obtain a desired height of the completed alphanumeric characters. The dot rows are formed coaxially about the longitudinal axis 96 of the cone 101. Because the diameter of the cone varies along the longitudinal axis 96 of the cone 101, the length or distance of linear travel of the pins 102 between rows is not equal to the distance between the rows of dots impressed on the cone 101. Also the impact pins 102 are positioned at a preselected angle A, such as 30 degrees, with respect to the longitudinal axis 96 as determined by the size of characters and spacing between characters.

Marking on the arcuate surface of a shaft 103 of a uniform diameter is shown in FIG. 8. In this example, the dots are imprinted in rows around the shaft 103. The dot rows are perpendicular to the longitudinal axis 96 of the shaft 103. Combined rotational and linear movement of the impact pins 102 as above described generates the desired pattern of dots for the characters to be formed. In this instance, the linear travel B of the carriage 30 is equal to the height C of the rows of dots forming the characters. Also for forming the circular array of dot rows on the shaft 103, the pins 102 extend at an angle A of 90° with respect to the longitudinal axis 96.

Figure 10:
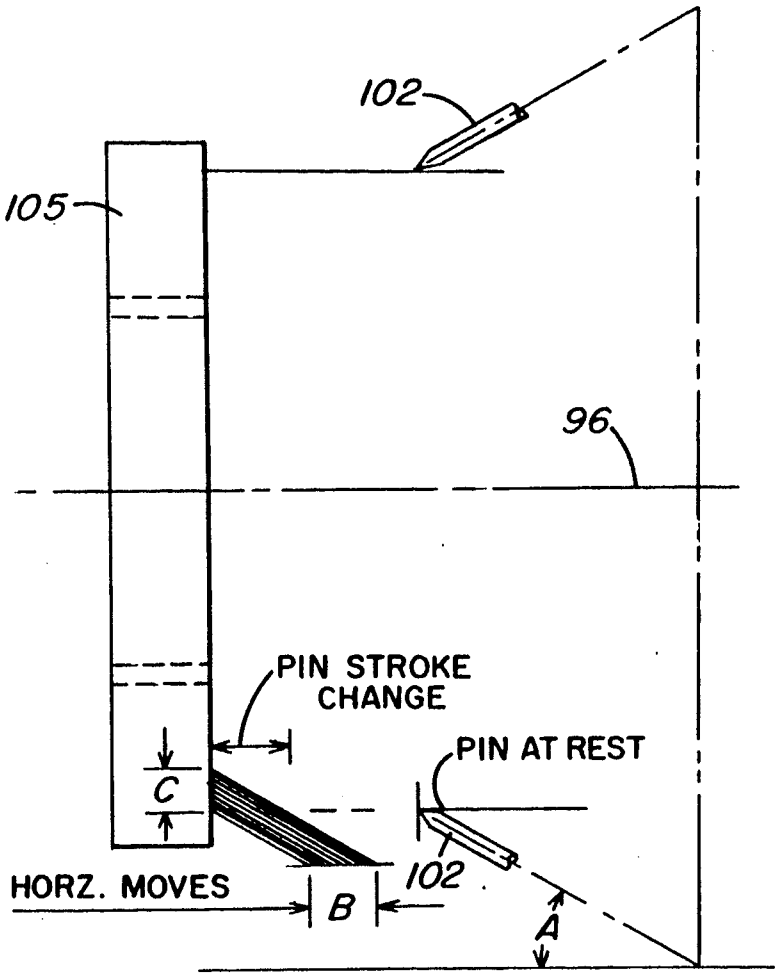
FIG. 10 is a view in side elevation of the plate shown in FIG. 9, schematically illustrating the position of an impact marker and range of horizontal movement of the impact marker for forming the array of characters on the plate as shown in FIG. 9.

Now referring to FIGS. 9 and 10 there is illustrated an example of forming rows of dots in an arcuate path on the planar surface of a round object, such as a circular plate 105, in accordance with the present invention. The rows of dots radiate on the flat plate surface about the longitudinal axis 96 of the plate 105. The rows of dots are also formed in the manner above described by the combined linear and rotational movement of the marking devices 80–94. The impact pins 102 are positioned at a preselected angle A, such as 30°, relative to the longitudinal axis 96. In this instance, the horizontal travel distance B of the carriage 30 is greater than the height C of the characters being formed due to the value of the angle A. Thus, when the value of angle A is 90°, the distance B and C are equal; however, when the angle A is less than 90° the travel distance B is greater than the character height C.

Now referring to FIGS. 11 and 12, there is illustrated a rotary marking apparatus 115 similar to the rotary marking apparatus 10 shown in FIGS. 1–4. The numerals used to designate the elements of the rotary marking apparatus 115 correspond to the numerals used to designate like elements of rotary marking apparatus 10 in FIGS. 1–4 described above. The rotor 72 is horizontally movable on the carriage 30 as above described, as well as, rotatable about the longitudinal axis 96 of the object 16 to be marked. The object 16, as shown in FIGS. 11 and 12 to be marked, is an elongated round member such as a shaft, pipe, or the like. The object 16 also has an arcuate surface 14 to be marked by a plurality of marking devices 80–94, having impact pins 102. The pins 102, as above described, are reciprocally movable within the body portion 100 by operation of solenoid valves 106 to extend and retract the impact pins 102 into contact with the arcuate surface 14 to impress a selected array of dots thereon.

With the arrangement of the marking devices 80–94 mounted on the rotor 72 as illustrated in FIG. 1, the impact pins 102 extend at an angle of less than 90° with respect to the longitudinal axis 96 of the object 16. With the embodiment of the rotary marking apparatus 115 shown in FIGS. 11 and 12, the marking devices 80–94 are positioned on the rotor 72 to extend the impact pins 102 at an angle of 90° or perpendicular to the longitudinal axis 96 of the object 16. To facilitate this arrangement of the marking devices 80–94 on the rotor 72, an enlarged circular plate 119 is connected by a frame 118 to the rotor 72. Frame 118 supports the plate 119 on the rotor 72 vertically with respect to the longitudinal axis 96 of the object 16. The circular plate 119 has an outer circular edge 120 and an inner circular edge 122.

As shown in FIG. 11, a plurality of elongated guide slots 124–138 are positioned in a circular array and spaced an equal distance apart around the plate 119. The slots 124–138 extend radially on the plate 119 from the center point of the plate 119 outwardly from the inner edge 122 through the outer edge 120. The slots 124–138 are equally spaced apart around the complete periphery of the plate 119. The marking devices 80–94 are reciprocally positioned in the slots 124–138. Each of the marking devices 80–94 is slidably retained in a slot by a combination fixed jib 140 and locking jib 142 as shown in FIG. 12. The fixed jib 140 is secured in place within the respective slots 124–138 by the locking jib 142.

The marking devices 80–94 mounted on the circular plate 119 shown in FIGS. 11 and 12 correspond to the single impact pin marking devices 80–94 discussed above. As determined by the diameter of the object 16 to be marked, the marking devices 80–94 are advanced to the required rest position within the slots 124–138 for positioning the impact pins 102 a preselected distance from the longitudinal axis 96 to advance into and out of contact with the arcuate surface 14. By operation of the computer controlled electric solenoid valves 106, the impact pins 102 indent the circumference of the round object 16 with dots to form desired alphanumeric characters on the circumference. With a plurality of the marking devices 80–94 spaced around the entire periphery of the object, a plurality of dots are simultaneously imprinted in a single row on the object.

The dots are formed in the raster pattern described above. The plate 119 is initially positioned for the impact pins 102 to form a first row of dots. This movement is followed by rotational movement through an arc of 45° in a first direction. The plate 119 is then linearly advanced, followed by rotational movement of the plate in the opposite direction through an arc of 45°. The combined linear and rotational movement of the plate 119 continues until the dots forming the desired characters are impressed on the circumference of the round object 16.

The movement of the impact pins 102 into and out of contact with the object 16 is controlled from an operator's terminal which is connected to a computer operated controller. From the controller, the characters to be imprinted on the circumference of the arcuate object 16 are selected and the selection is made from a data entry terminal which is located remote from the location of the plurality of marking devices 80–94. The controller generates data in character signals which are transmitted to the electric solenoid valves 106 that control the extension and retraction of the impact pins 102 to indent the circumference of the round object 16 with dots.

According to the provisions of the patent statutes, I have explained the principle, preferred construction, and mode of operation of my invention and have illustrated and described what I now consider to represent its best embodiment. However, it should be understood that, within the scope of the appended claims, the invention may be practiced otherwise than as specifically illustrated and described.

I claim:

1. Apparatus for marking a selected array of characters in an arcuate path on the surface of an object comprising, a support member positioned adjacent to the object to be marked, said support member having a reference plane parallel to an axis of the object, a carriage mounted on said support member for movement parallel to said reference plane with the object to be marked remaining fixed relative to said carriage, first drive means drivingly connected to said carriage for linearly moving said carriage to a preselected position on said support member relative to the surface of the object, a rotor supported by said carriage in coaxial alignment with the surface of the object to be marked for rotation relative to the object in a preselected direction, marking means for imprinting a selected array of characters on the surface of the object, means for supporting said marking means radially on said rotor for movement into and out of contact with the surface of the object, second drive means connected to said rotor for rotating said rotor through a preselected angle in a first direction about the axis of the object, actuating means for selectively actuating said marking means to mark the surface of the object with portions of the selected array of characters on a first line radiating in an arcuate path about the axis of the object as the rotor rotates in a first direction through a preselected angle about the object, said first drive means linearly moving said carriage a preselected distance on said support member for rotation of said rotor by said second drive means in a second direction opposite to said first direction through a preselected angle, and said actuating means actuating said marking means to mark the surface of the object on a second line spaced from and radiating in an arcuate path parallel to said first line with the other portions of said selected array of characters.

2. Apparatus as set forth in claim 1 which includes, means for supporting the object to be marked in a stationary position relative to said rotor, said rotor having an axis of rotation coaxially aligned with the axis of the object, and said rotor being linearly movable with said carriage on said axis to selectively position said marking means at a preselected position opposite the surface of the object.

3. Apparatus as set forth in claim 1 which includes, a housing mounted on said carriage, said second drive means including a drive shaft rotatably mounted in said housing, said drive shaft having a first end portion, a second end portion, and an axis of rotation coaxially aligned with the axis of the object, a motor mounted on said carriage and drivingly connected to said drive shaft first end portion for programmed rotation of said drive shaft in a first directional through a preselected angle followed by rotation in a second direction opposite to said first direction through a preselected angle, and said rotor nonrotatably connected to said drive shaft second end portion for rotation therewith.

4. Apparatus as set forth in claim 1 in which, said marking means includes a plurality of marking devices positioned radially in spaced relation on said rotor around the surface of the object to simultaneously imprint the selected array of characters in the arcuate path around the circumference of the surface of the object.

5. Apparatus as set forth in claim 1 in which, said means for supporting said marking means radially on said rotor includes a hub portion connected to said rotor to rotate with said rotor, said hub portion including an inclined peripheral surface, and said marking means positioned on said inclined peripheral surface to extend at a preselected angle relative to the axis of the object toward the surface of the object.

6. Apparatus as set forth in claim 5 in which, said actuating means actuates said marking means to impact the surface of the object as the rotor rotates in a first direction through a preselected angle to form a first row of dots radiating about the axis on the surface of the object, said first drive means being operable to linearly advance said carriage a preselected distance on said support member to position said marking means in position for forming a second row of dots radiating about the axis on the surface of the object, and said rotor being rotatable in a second direction opposite to said first direction as said marking means impacts the object to form a second row of dots spaced a preselected distance and parallel to the first row of dots on the surface of the object.

7. Apparatus as set forth in claim 6 in which, said carriage includes means for slidably engaging said support member for movement in a horizontal reference plane to horizontally advance said marking devices relative to the surface of the object, and said first drive means being actuated to incrementally move said carriage a preselected linear distance on said support member after rotational movement of said rotor to maintain the rows of dots a preselected distance apart on the surface of the object.

8. Apparatus as set forth in claim 7 which includes, means for adjusting the distance of linear movement of said carriage on said support member after rotational movement of said rotor to maintain the rows of dots formed on the surface of the object spaced an equal distance apart.

9. Apparatus as set forth in claim 1 in which, said rotor is rotated by said actuating means from a starting point on the surface of the object in said first direction through an angle of 45° about the axis of the object, and said rotor being rotatable in said second direction through an angle of 45° back to said starting point.

10. Apparatus as set forth in claim 1 in which, said means for supporting said marking means on said rotor includes a circular plate having at least one guide slot radially positioned on said plate, said guide slot extending radially on said plate from a center point thereof outwardly to an outer edge of said circular plate, and said marking means being reciprocally positioned in said guide slot to move toward and away from said center point and extend said impact pin at an angle of 90° with respect to the axis of the object.

11. Apparatus as set forth in claim 10 in which, said impact pin is actuated by said actuating means to move into and out of contact with the surface of the object to impress a plurality of dots on the object as said rotor moves in an arcuate path relative to the surface of the object.

12. A method for marking a selected array of characters on the surface of an object comprising the steps of, positioning a carriage on a support member for movement parallel to a reference plane with the object to be marked remaining fixed relative to the carriage, linearly moving the carriage coaxially relative to the surface of the object to a preselected position on the support member, positioning a rotor on the carriage in coaxial alignment with an axis of the object, positioning marking means radially on the rotor for imprinting a selected array of characters on the surface of the object, rotating the rotor through a preselected angle in a first direction about the axis of the object, actuating the marking means to mark the surface of the object with portions of the selected array of characters on a first line radiating about the axis of the object as the rotor rotates in a first direction through a preselected angle relative to the object remaining fixed, linearly moving the carriage on the support member to move the rotor relative to the object, rotating the rotor in a second direction opposite to the first direction through a preselected angle, and actuating the marking means upon rotation of the rotor in the second direction to mark the surface of the object on a second line spaced from and parallel to the first line with the other portions of the selected array of characters.

13. A method as set forth in claim 12 which includes, positioning a plurality of the marking means an equal radial distance apart around the rotor, extending an impact pin from each marking means at a preselected angle relative to the reference plane toward the surface of the object, moving the impact pins from an initial rest position into contact with the surface of the object to impress dots in a first row on the surface of the object, forming simultaneously the first row of dots in an arcuate path on the surface of the object at preselected intervals as the rotor rotates in a first direction about the axis of the object, advancing the carriage linearly a preselected distance for forming a second row of dots spaced a preselected distance from the first row of dots on the surface of the object, and forming simultaneously the second row of dots in an arcuate path in spaced parallel relation to the first row of dots on the surface of the object as the rotor rotates in a second direction opposite to the first direction about the axis of the object.

14. A method as set forth in claim 13 which includes, rotating the rotor through an equal angle in the first and second direction, and forming a preselected number of spaced, parallel rows of dots in an arcuate path on the surface by successively rotating the rotor and linearly advancing the rotor to form a desired array of characters from the rows of dots impressed on the surface of the object.

15. A method as set forth in claim 12 which includes marking the surface of a cylinder with the portions of the selected array of characters positioned on a line extending coaxially about a longitudinal axis of the cylinder on the arcuate surface of the cylinder.

16. A method as set forth in claim 12 which includes, marking the surface of a cone with the portions of the selected array of characters positioned on a line extending coaxially about a longitudinal axis of the cone on the arcuate surface of the cone.

17. A method as set forth in claim 12 which includes, marking the vertical surface on the end of a cylindrical member with portions of the selected array of characters positioned on a line extending about the radius of the cylindrical member.

18. A rotary marking device comprising:

a rotor, support means for rotatably supporting said rotor about an axis coaxially aligned with an axis of an object having an arcuate surface to be marked, said rotor being linearly movable on said support means along said axis, a marking device for imprinting a selected array of characters on the arcuate surface of the object, positioning means for positioning said marking device to extend radially on said rotor relative to the arcuate surface of the object, means for actuating said marking device to selectively imprint an array of characters on the arcuate surface of the object, and drive means for combined sequential movement of said rotor first rotationally in a selected direction through a preselected angle about said axis followed by linearly advancing said rotor along said axis as said marking device marks the arcuate surface of the object with dots in a raster pattern to form the selected characters on the arcuate surface of the object, said drive means providing said combined sequential movement simultaneously with the marking of said marking device.

19. A rotary marking device as set forth in claim 18 which includes, an impact pin extending from said marking device at a preselected angle relative to said axis to impact the arcuate surface of the object and impress a dot thereon, and said marking device being selectively actuated during rotation of said rotor to form a plurality of dots in a first row on the arcuate surface around the object.

20. A rotary marking device as set forth in claim 19 which includes, means for incrementally, linearly advancing said rotor after rotation of said rotor through a preselected angle to position said impact pin relative to the object for forming on the arcuate surface a second row of dots spaced a preselected distance from and parallel to said first row of dots.

* * * * *